US009010561B2

(12) United States Patent
Kobayashi

(10) Patent No.: US 9,010,561 B2
(45) Date of Patent: Apr. 21, 2015

(54) CAN LID AND CAN CONTAINER EQUIPPED WITH THE SAME

(75) Inventor: Toshiya Kobayashi, Tokyo (JP)

(73) Assignee: Suntory Holdings Limited, Osaka-shi, Osaka (JP)

( * ) Notice: Subject to any disclaimer, the term of this patent is extended or adjusted under 35 U.S.C. 154(b) by 902 days.

(21) Appl. No.: 11/884,671

(22) PCT Filed: Dec. 21, 2005

(86) PCT No.: PCT/JP2005/023506

§ 371 (c)(1),
(2), (4) Date: May 20, 2009

(87) PCT Pub. No.: WO2006/090525

PCT Pub. Date: Aug. 31, 2006

(65) Prior Publication Data

US 2010/0032433 A1 Feb. 11, 2010

(30) Foreign Application Priority Data

Feb. 23, 2005 (JP) ..... 2005-047305

(51) Int. Cl.
*B65D 17/34* (2006.01)
*B65D 17/00* (2006.01)

(52) U.S. Cl.
CPC ..... *B65D 17/165* (2013.01); *B65D 2517/0014* (2013.01); *B65D 2517/0079* (2013.01)

(58) Field of Classification Search
CPC ..... B65D 17/65; B65D 2517/0014
USPC ..... 220/269, 906, 270, 805
See application file for complete search history.

(56) References Cited

U.S. PATENT DOCUMENTS

| | | | | | |
|---|---|---|---|---|---|
| 3,437,227 | A | * | 4/1969 | Peyser | 220/269 |
| 3,744,666 | A | * | 7/1973 | Heffner | 220/269 |
| 3,900,128 | A | * | 8/1975 | Brown | 220/269 |
| 3,989,161 | A | | 11/1976 | Pillnik | |
| 4,078,695 | A | * | 3/1978 | Potts | 220/269 |
| 4,367,996 | A | | 1/1983 | Saunders | |
| 4,397,403 | A | * | 8/1983 | Guimarin | 220/269 |

(Continued)

FOREIGN PATENT DOCUMENTS

| | | |
|---|---|---|
| JP | 56-104763 | 8/1981 |
| JP | 56-52978 | 12/1981 |

(Continued)

OTHER PUBLICATIONS

European Search Report mailed Apr. 14, 2009 issued in European Application No. 05820350.6.

*Primary Examiner* — Fenn Mathew
*Assistant Examiner* — Kevin Castillo
(74) *Attorney, Agent, or Firm* — Drinker Biddle & Reath LLP

(57) ABSTRACT

An object of the present invention is to provide a can lid allowing for a tab to be pulled up in an appropriate manner without inducing tab turning and also to provide a can container equipped with the same can lid, and provided is a can lid 1 comprising a can lid body 3 having an opening region 5 to be open upon being opened and a tab 9 fixed to the can lid body 3, in which the tab 9 comprises a pull-up section 9*a* on which a user's finger is hooked in his/her opening action, and the can lid body 3 comprises a guide section 10*a* for guiding the user's finger to a center of the pull-up section 9*a*.

7 Claims, 7 Drawing Sheets

(56) References Cited

U.S. PATENT DOCUMENTS

| | | | | | |
|---|---|---|---|---|---|
| 4,417,668 | A | * | 11/1983 | Stolle | 220/269 |
| 4,524,879 | A | | 6/1985 | Fundom et al. | |
| 5,038,956 | A | | 8/1991 | Saunders | |
| 5,062,542 | A | * | 11/1991 | Morton | 220/269 |
| 5,129,541 | A | | 7/1992 | Voigt et al. | |
| 5,224,618 | A | | 7/1993 | Garbiso | |
| 6,050,440 | A | * | 4/2000 | McEldowney | 220/269 |
| 6,138,856 | A | | 10/2000 | Ghim et al. | |
| 6,443,323 | B1 | * | 9/2002 | DeRose | 220/257.1 |

FOREIGN PATENT DOCUMENTS

| | | |
|---|---|---|
| JP | 2-502814 | 9/1990 |
| JP | 03-014455 | 1/1991 |
| JP | HEI 5-89231 | 12/1993 |
| JP | 3005982 | 10/1994 |
| JP | 8-29781 | 3/1996 |
| JP | 9-86538 | 3/1997 |
| JP | 3052786 | 10/1998 |
| JP | 11-105870 | 4/1999 |
| JP | 11-321862 | 11/1999 |
| JP | 2002-59928 | 2/2002 |
| JP | 2002-179062 | 6/2002 |
| JP | 2004-196349 | 7/2004 |
| JP | 2004-210318 | 7/2004 |
| JP | 2004-525820 | 8/2004 |
| WO | 02/08074 A1 | 1/2002 |

* cited by examiner (A)

(B)

(A)

(B)

(A)

(B)

(C)

(A)

(B)

CAN LID AND CAN CONTAINER EQUIPPED WITH THE SAME

CROSS REFERENCE TO RELATED APPLICATIONS

This application is the National Stage of International Application No. PCT/JP2005/023506, filed Dec. 21, 2005, and claims benefit of Japanese Patent Application No. 47305/2005, filed Feb. 23, 2005, both of which are herein incorporated by reference in their entirety.

TECHNICAL FIELD

The present invention relates to a can lid and a can container equipped with the same, and particularly to a can lid made in such a type that an opening region of the can lid can be opened by pulling up what is called a tab and also to a can container equipped with the same can lid.

BACKGROUND ART

Conventionally, a can container commonly used for containing soft drink, alcoholic beverages and even foods and the like comprises a cylindrical can body having a bottom and a disk-like can lid for closing an open end of the can body. Recently, the can lids used in the above type of can container have mostly employed a certain type of tab, or what is called a stay-on tab, in which the tab is placed in a partially coupled state with the can body even after opening of the can lid. This stay-on type tab is attached to the can lid via a rivet arranged integrally in a substantially central region of a can lid body.

In such fastening of the tab with use of the rivet, if the used rivet has a poor fastening force, the tab could be easily turned around the rivet in parallel with the can lid body, or substantially along the horizontal plane. This is a phenomenon referred to as "tab turning". The tab turning may occur in a manufacturing process and/or a packaging process and may also possibly occur when a user pulls up the tab at a location offset from a central region of a lift-up section of the tab.

The event of the tab turning can alter the physical relationship between an opening region (tear-strip) and a tab tip end (tab nose). Since the tab nose defines a section serving to apply a force to the opening region during the opening process, any change in the above physical relationship could prohibit a predetermined pressing force from being obtained. In addition, if there is occurrence of severe tab turning, the tab nose may be shifted away from the opening region, bringing about obstacles in opening and ending up with a problem of the opening ability.

In order to avoid such problems, many different means have been used to prevent the tab turning. There is one such related art technique by way of example that has employed a non-circular rivet so as to prevent the tab turning. In the related art technique, the rivet is configured to have an elliptical shape in cross section, so that the tab would not turn even if such a great force that could turn the tab were applied to the tab. In this technique, the conventional design can be still employed for other aspects than the rivet geometry (see following related art 1). There are other related art techniques as disclosed, including one type of can lid that includes a protrusion referred to as a tab dimple disposed in the can lid and another type of can lid that is manufactured by using a favorably modified pressing degree of a rivet (see following related art 2).

FIG. 6 shows a related art technique, in which a finger inserting recess 58 is formed in an area of the can lid body adjacent to a pull-up section 59*a* of a tab 59. The finger inserting recess 58 defines a recess to facilitate hooking action by a user in hooking his/her finger on the pull-up section 59*a* of the tab 59.

[Related Art 1]

Japanese Patent Public Disclosure No. 2002-179062

[Related Art 2]

Japanese Patent Public Disclosure No. 2004-196349

DISCLOSURE OF THE INVENTION

Problems to be Solved by the Invention

However, there are some drawbacks in association with the above-described related art techniques, as will be described below. Specifically, forming the non-circular cross-section geometry of the rivet requires that a press die should be modified to have a particular configuration for forming the above rivet. In addition, in case of the tab that is fixed in a position rotationally offset from a designed location, even if the user may notice the actual tab turning, it would be impossible to correct the tab turning anymore.

Moreover, in the technique that teaches the protrusion referred to as the tab dimple formed in the can lid body, the tab, if pulled up only by a small distance, could depart from the protrusion, and consequently, any rotational force applied to the tab in the above condition may cause the tab turning. Further, even if the pressing degree of the rivet were favorably modified, the tab turning would not be fully eliminated so far as the cross sectional geometry of the rivet is circular.

Further in the technique employing the finger inserting recess, the finger inserting recess has a predetermined width but it is not serving to allow a user's finger to be guided to the center of the pull-up section of the tab, again failing to prevent the tab turning completely.

Means for Solving the Problems

The present invention has been made based on a finding that the problem of the tab turning could not arise, if the tab is pulled up in its proper region, without any inventive modification to be applied, such as the rivet cross sectional geometry and the like as disclosed in the related art techniques.

Specifically, the present invention provides a can lid comprising a can lid body having an opening region to be open upon being opened and a tab fixed to the can lid body, said can lid characterized in that the tab comprises a pull-up section on which a user's finger is hooked in his/her opening action, and that the can lid body comprises a guide section for guiding the user's finger to a center of the pull-up section. The present invention is further characterized in that in place of or in combination with the guide section, a positioning section is formed in the can lid body for positioning the user's finger in the center of the pull-up section. The present invention further provides a can container comprising the can lid as defined above.

Effects of the Invention

According to the present invention, since the user's finger is guided to the center of the pull-up section of the tab in an appropriate manner, therefore the tab turning can be effectively prevented. More advantageously, for a person having a weak eyesight in handling the can lid, his/her finger is guided in an appropriate manner, so that he/she can pull-up the tab appropriately.

Further, even if the tab is fixed as in the condition where the tab turning has arisen during the manufacturing process, a cross sectional geometry of a rivet that is circular still allows the user to correct the tab turning by himself/herself (the correction is not possible with the non-circular cross sectional geometry of the rivet).

BRIEF DESCRIPTION OF THE DRAWINGS

FIG. 1 shows a can lid according to a first embodiment of the present invention, wherein FIG. 1(A) is a plan view and FIG. 1(B) is a sectional view taken along X1-X1 line of FIG. 1(A);

FIG. 2 shows a can lid according to a second embodiment of the present invention, wherein FIG. 2(A) is a plan view and FIG. 2(B) is a sectional view taken along X2-X2 line of FIG. 2(A);

FIG. 3 shows a can lid according to a first example of a third embodiment, wherein FIG. 3(A) is a plan view and FIG. 3(B) is a sectional view taken along X3-X3 line of FIG. 3(A);

FIG. 4 is a partial plan view of a can lid according to the third embodiment of the present invention, wherein FIG. 4(A) is a second example, FIG. 4(B) is a third example, and FIG. 4(C) is a fourth example, respectively, of the third embodiment;

FIG. 6 shows a can lid according to the prior art, wherein FIG. 6(A) is a plan view and FIG. 6(B) is a sectional view taken along the X4-X4 line of FIG. 6(A)

DESCRIPTION OF REFERENCE NUMERALS

1, 11, 21 Can lid
3, 13, 23 Can lid body
5, 15, 25 Opening region
, 17, 27 Rivet
9, 19, 29 Tab
9*a*, 19*a*, 29*a* Pull-up section
10, 20 Guide section
10*b* Guide plane
10*c* Oblique line
10*d* Guide wall
30 Positioning section

BEST MODE FOR CARRYING OUT THE INVENTION

First Embodiment

Figure 1:
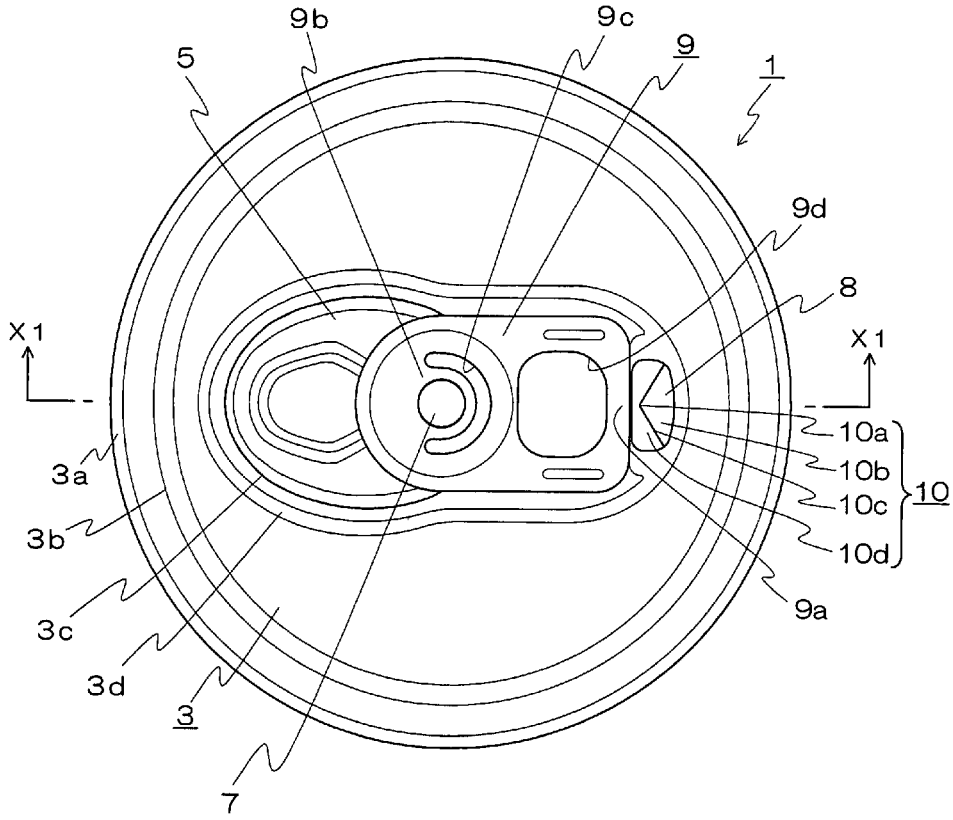
Figure 1:
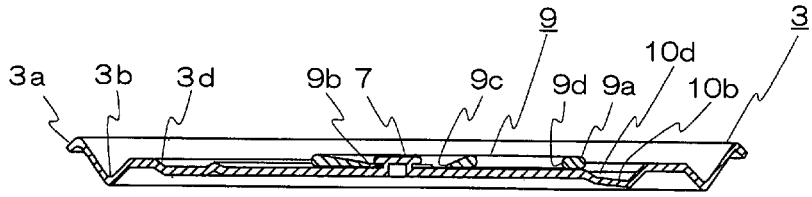

An embodiment of the present invention will now be described with reference to the attached drawings. FIG. 1 shows a can lid according to a first embodiment of the present invention, wherein FIG. 1(A) is a plan view and FIG. 1(B) is a sectional view taken along the X1-X1 line of FIG. 1(A), respectively. The illustrated can lid represents one intended to use in a can container for beverages by way of example. It is to be noted that although the thickness of each of components in FIG. 1(B) is expressed in an exaggerated form for convenience of description, the each component is actually made of thin plate of aluminum or steel and thus actually formed of the thin member.

As shown in FIG. 1, a can lid 1 according to the illustrated embodiment has a circular can lid body 3 comprising an opening region 5 to be open to form a tap upon being opened and a tab 9 secured to the can lid body 3 with a rivet 7. A rear end of the tab (right end in FIG. 1(A)) defines a pull-up section 9*a* on which a user's finger is hooked for pulling up. In addition, a properly designed guide section 10 is formed in the can lid body 3 at a location corresponding to the pull-up section 9*a*. Each of the components will now be described in detail.

[Can Lid Body]

As previously mentioned, the can lid body 3 has a circular configuration in plan view and adapted to seal an opening of a cylindrical can body having a bottom, though not shown. A turn-back section 3*a* is formed along a periphery of the can lid 1 for joining to the can body. In addition, a predetermined groove 3*b* is formed in an inner side with respect to the turn-back section 3*a*. However, it is to be appreciated that the groove 3*b* is not essential but may be omitted. An area encircled by the groove provides a substantially flat plane and a central region of the can lid 3 disposed in an inner side relative to the flat plane is defined to be lower level than the flat plane via a stepped section 3*d*. Further, the opening region 5 is formed in said central region of the can lid 3, which is to be open to form the tap upon being opened. The opening region 5 is configured to be cut out along a score 3*c* (imprint) assuming a partially elliptical contour extending from a tip end (left end in FIG. 1(A)) toward the central region of the can lid 3. However, it is to be noted that since the score 3*c* is not formed to extend entirely along a periphery of the opening region 5, the opening region 5 would not be separated from the can lid body 3 even after the opening operation.

The tab 9 fixed to the can lid body 3 will now be described. The tab 9 is substantially semi-circular in its front end (left end in FIG. 1(A)) and substantially rectangular in its rear end (right end in FIG. 1(A)). The front end of the tab is disposed at a location abutting to the opening region, so that a pulling-up action of the tab can press the opening region downward. On the other hand, the rear end of the tab 9 forms a pull-up section 9*a*, defining a section allowing for a user's finger to be hooked for pulling up. The tab 9 is fixed to the can lid body 3 via a fastening area 9*b* with use of the rivet 7, which will be described later. A semi-circular slit 9*c* having a predetermined width is formed in the pull-up section 9*a* of the tab 9 around the rivet 7. A finger hooking slot 9*d* is formed in the tab 9 at a location adjacent to the pull-up section 9*a*.

[Guide Section]

A guide section 10 will now be described. The guide section 10 is formed in a finger inserting recess 8 of the can lid body 3 at an area adjacent to the pull-up section 9*a*. The finger inserting recess 8 defines a more concavely recessed portion than the surrounding area. This finger inserting recess 8 is the area in which a guide section 10 is additionally formed. The guide section 10 according to the illustrated embodiment is formed with a sloped guide plane 10*b* of a triangular shape with an apex 10*a* located proximal to the center of the pull-up section 9*a* and a guide wall 10*d* connecting to each oblique line 10*c* of the guide plane. To explain specifically, a rear end of the finger inserting recess 8 (right end in FIG. 1(A)) defines a most concavely recessed portion and the concavity is getting shallower gradually from the rear end of the finger inserting recess 8 toward the center of the pull-up section 9*a*. The concavity is shallowest in the vicinity of the pull-up section 9*a* (see FIG. 1(B)). In association with this configuration, respective guide walls 10*d* connecting to respective oblique lines 10*c* are configured such that a distance between the guide walls 10*d* is gradually narrowing toward the apex 10*a* so as to guide the user's finger in the opening action into the center of the pull-up section 9*a*. It is to be appreciated in this connection that although the guide plane 10*b* is tilted with respect to a horizontal plane such that the concavity is getting shallower toward the apex 10*a* in the embodiment as shown in FIG. 1, the present invention is not limited to this. Specifically, the guide section 10 may be formed with a sloped guide plane having its concavity getting deeper toward the apex and a guide wall connecting to the guide plane. It is to be noted that the guide section 10 may be formed by the press work using a die or the like simultaneously with the formation of the can lid body 3 or may be formed in a separate process after the formation of the can lid body 3.

[Rivet]

The rivet 7 will now be described. The rivet 7 serves to fasten the tab 9 to the can lid body 3. The rivet 7 in the illustrated embodiment is formed integrally with the can lid body 3. Specifically, the rivet 7 as before fastening the tab 9 exhibits a circular column configuration protruding upward from the central region of the can lid body 3. Then, the tab is inserted over the circular column-like rivet and the rivet is pressed and collapsed to define the configuration of the rivet 7 as shown in FIG. 1. It is to be noted that since the rivet 7 of the illustrated embodiment is circular configuration, and if the tab turning had arisen in the manufacturing process, the user to open the can lid could correct the tab turning by himself/herself. This is an aspect of great difference from the prior art that has taught the rivet having an elliptical shape in cross section.

[Operation]

An operation of the can lid 1 according to the illustrated embodiment will now be described. It is to be noted that although only the can lid 1 is shown in FIG. 1, the can lid of the present invention is essentially contemplated to be joined with a can body (not shown) and used in the form of a can container, and the description is herein given on the premise of the can lid having been already joined with the can body.

Firstly, a user holds the can body to stable the can container. Secondly, he/she tries to hook a finger on the pull-up section 9*a* of the tab 9. In this step, owing to the finger inserting recess 8 formed in the vicinity of the pull-up section 9*a*, the user's finger is guided to the site near the pull-up section 9*a*. Additionally, the guide section 10 is formed in the finger inserting recess 8. With the aid of this, as the user in the opening action tries to place his/her finger close to the pull-up section 9*a*, the finger is guided along the slope of the guide section 10 to near the guide section tip end 10*a*. Since the guide tip end 10*a* is positioned near the center of the pull-up section 9*a*, the user's finger in the opening action is accordingly led to near the center of the pull-up section 9*a*.

In this condition, the user can successfully hooked his/her finger on the pull-up section 9*a* to pull up the tab 9. Since the semi-circular slit 9*c* is formed in the tab 9 as described above, therefore in association with the pulling-up of the pull-up section 9*a*, the tab 9 is rotated around the vicinity of the rivet 7 and pulled up. As a result, the tip end of the tab 9 can press down the opening region 5. As the opening region 5 is pressed down, the opening region 5 tends to break along the score to form the tap.

Figure 7:
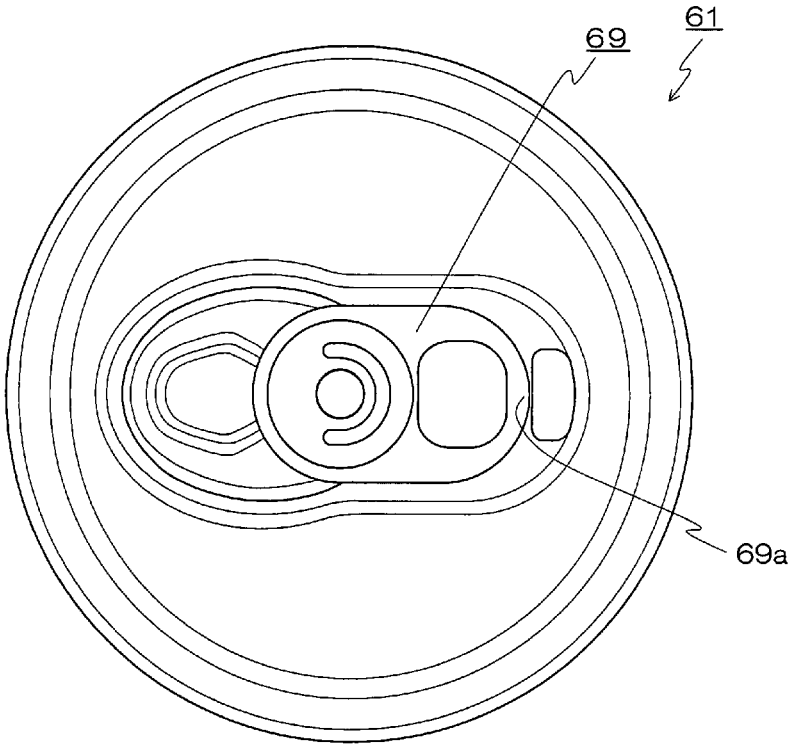
FIG. 7 is a plan view showing another example of a can lid according the prior art.

As described above, in the can lid 1 of the illustrated embodiment, since the user's finger is guided to the center of the pull-up section 9*a* by the guide section 10, therefore it becomes possible to pull up the tab 9 appropriately and thus to prevent the tab turning reliably. Further advantageously, in the illustrated embodiment, since the guide section 10 comprises the sloped guide plane of the triangular shape having its apex located at a point proximal to the center of the pull-up section 9*a* of the tab 9 and at the same time the rear end of the pull-up section 9*a* is formed into a linear shape, therefore the physical relationship between the apex of the guide plane and the pull-up section can be easily recognized and any events of tab turning can be immediately made aware of. This aspect is a significant difference from the can lid 61 having the circular pull-up section 69*a* of the tab 69 shown in FIG. 7. Further, a type of imprint such as a groove may be disposed in the center of the pull-up section 9*a* of the tab 9. This provides more easy recognition of the physical relationship (tab turning) of the tab 9 relative to the can lid body.

Second Embodiment

Figure 2:
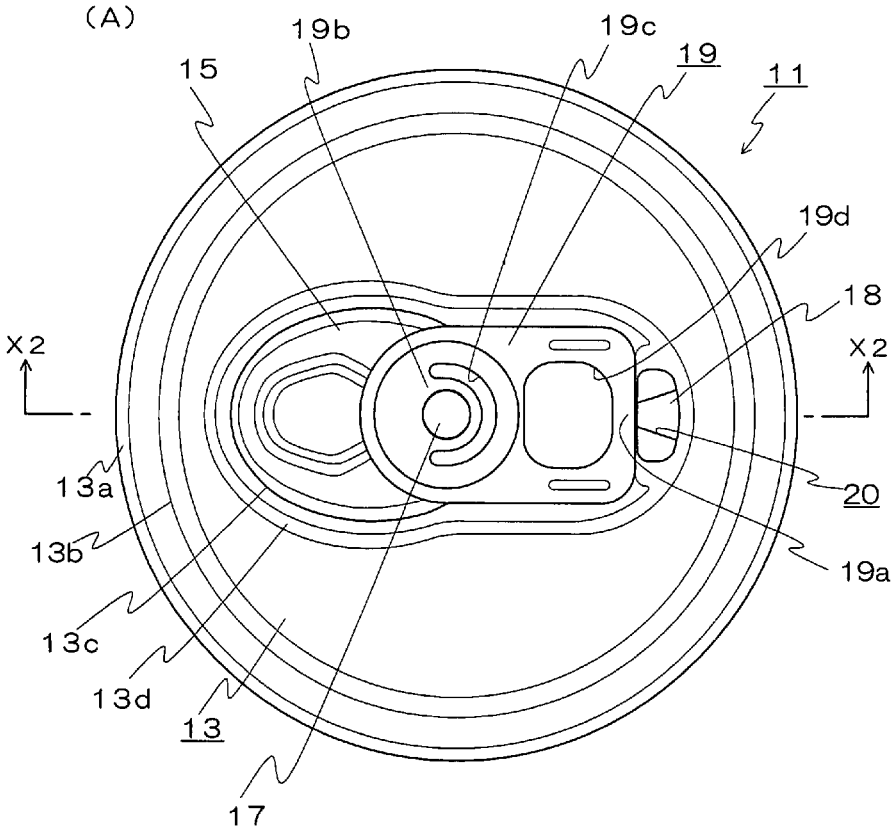
Figure 2:
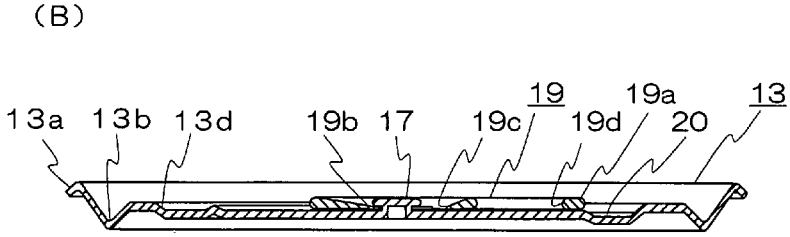

A can lid 11 according to a second embodiment of the present invention will now be described with reference to FIG. 2. The can lid 11 according to the illustrated embodiment is generally similar to the first embodiment except a guide section 20, and any duplicated descriptions may be herein omitted.

A guide section 20 of the illustrated embodiment provides two stepped planes formed in a finger inserting recess 18 and configured such that the distance therebetween is gradually narrowing toward a center of a pull-up section 19*a*. Specifically in the illustrated embodiment, the finger inserting recess 18 extends such that the two stepped planes extending from a rear end of the finger inserting recess 18 (right end in FIG. 2(B)) toward an area adjacent to the pull-up section 19*a* defines a trapezoid. It is to be noted that differently from the first embodiment, the depth of the concavity of the guide section 20 would not change as approaching to the area adjacent to the pull-up section 19*a*. It is needless to say that the stepped plane for the purpose of the present invention is referred to the stepped plane comprising not only a vertical plane but also an oblique plane.

As described herein, since the guide section 20 is constructed to from the two stepped planes defining a trapezoidal shape therebetween, therefore as a user places his/her finger into a finger inserting recess 18 and brings it close to the pull-up section 19*a*, the finger is guided along the stepped planes so that the finger can be hooked in the center of the pull-up section 19*a*. If the pull-up section 19*a* is pulled up in the above condition, the tab turning can be successfully avoided. It is to be noted that the guide section geometry is not limited to the trapezoidal shape but may be formed in a triangular shape. In other words, any geometry that can guide the user's finger into the center of the pull-up section 19*a* of the tab 19 may be employed.

Third Embodiment

A can lid 21 according to respective examples of a third embodiment will now be described with reference to FIGS. 3 and 4. Since main components of the can lid 21 of the illustrated embodiment are similar to those in the first embodiment, any duplicated descriptions on the common parts may be herein omitted.

Figure 3:
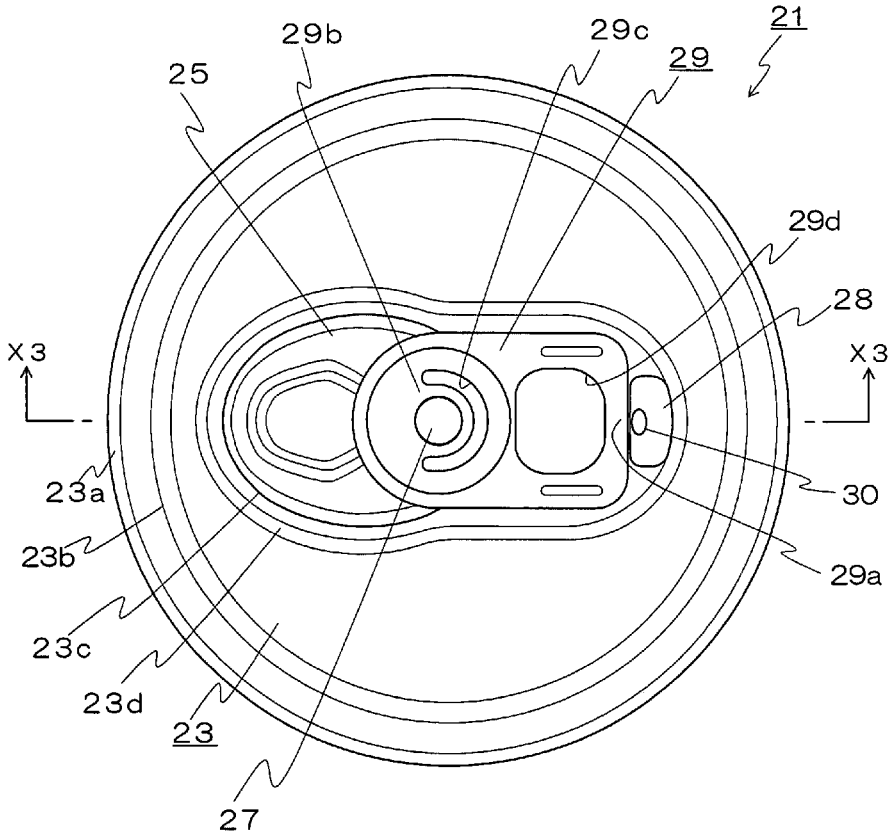
Figure 3:
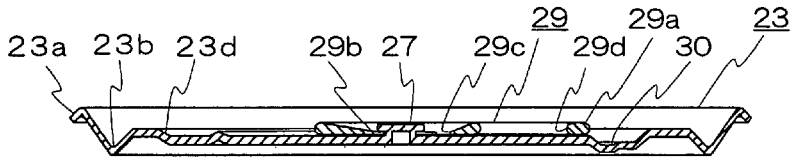
Figure 4:
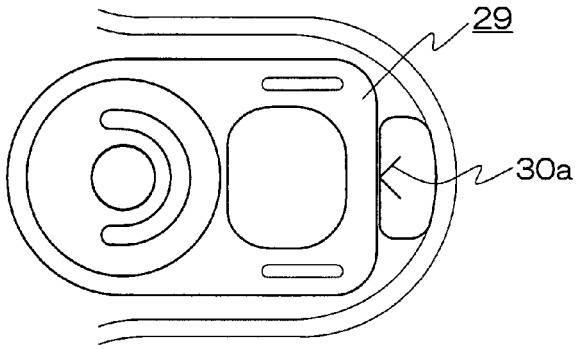
Figure 4:
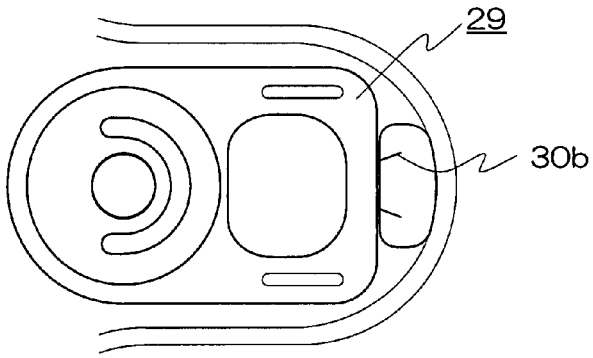
Figure 4:
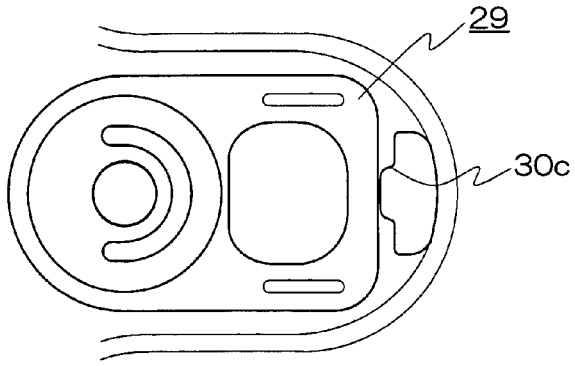

In a first example of the illustrated embodiment of FIG. 3, a positioning section 30 is formed in place of the guide section 10 in the first embodiment. The positioning section 30 is an additional recessed section defined in a finger inserting recess 28 and disposed in an area adjacent to a center of a pull-up section 29*a*. Although the positioning section 30 defines an elliptical recessed section, the geometry thereof is not particularly limited. In other words, it should be only a little more recessed than the finger inserting recess 28.

As described herein, since the positioning section 30 is defined by the recessed portion, when a user inserts his/her finger in the finger inserting recess 28 and brings it close to the pull-up section 29*a*, he/she may recognize the positioning section 30, which facilitates his/her hooking action of the finger in the center of the pull-up section 29*a*. If the pull-up section 29*a* is pulled up in this condition, the tab turning can be successfully avoided.

A second example of the illustrated embodiment will now be described with reference to FIG. 4(A). A positioning section 30*a* according to the second example provides two stepped planes exclusively defined in an area adjacent to the center of the pull-up section of the tab 29. The stepped planes are configured such that a distance therebetween is gradually narrowing toward the area adjacent to the pull-up section and the two planes intersect with each other in a point adjacent to the pull-up section to thereby form such as an apex of a triangle. This allows for the user's finger to be successfully positioned in the center of the pull-up section with the aid of respective stepped planes.

A third example of the illustrated embodiment will now be described with reference to FIG. 4(B). A positioning section 30*b* according to the third example also provides two stepped planes exclusively defined in an area adjacent to the center of the pull-up section of the tab 29. Those stepped planes are configured such that a distance therebetween is gradually narrowing toward the area adjacent to the pull-up section but spaced apart from each other by a predetermined distance in the area adjacent to the pull-up section to thereby define a geometry like a trapezoid. This feature can also facilitate the hooking action by the user in hooking the finger in the center of the pull-up section with the aid of respective stepped planes.

Further, a fourth example of the illustrated embodiment will now be described with reference to FIG. 4(C). A positioning section 30*c* according to the fourth example is configured as a part of the finger inserting recess. Specifically, the finger inserting recess in an area adjacent to the center of the pull-up section of the tab 29 has a smaller width, so that a finger tip of the user can be positioned in this narrow positioning section.

Figure 5:
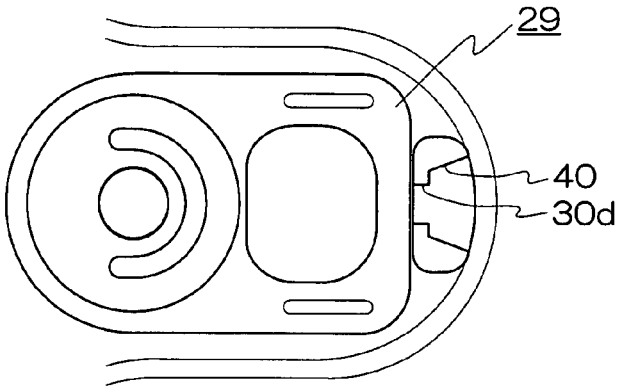
FIG. 5 is a partial plan view of a can lid according to yet another example of the present invention.
Figure 6:
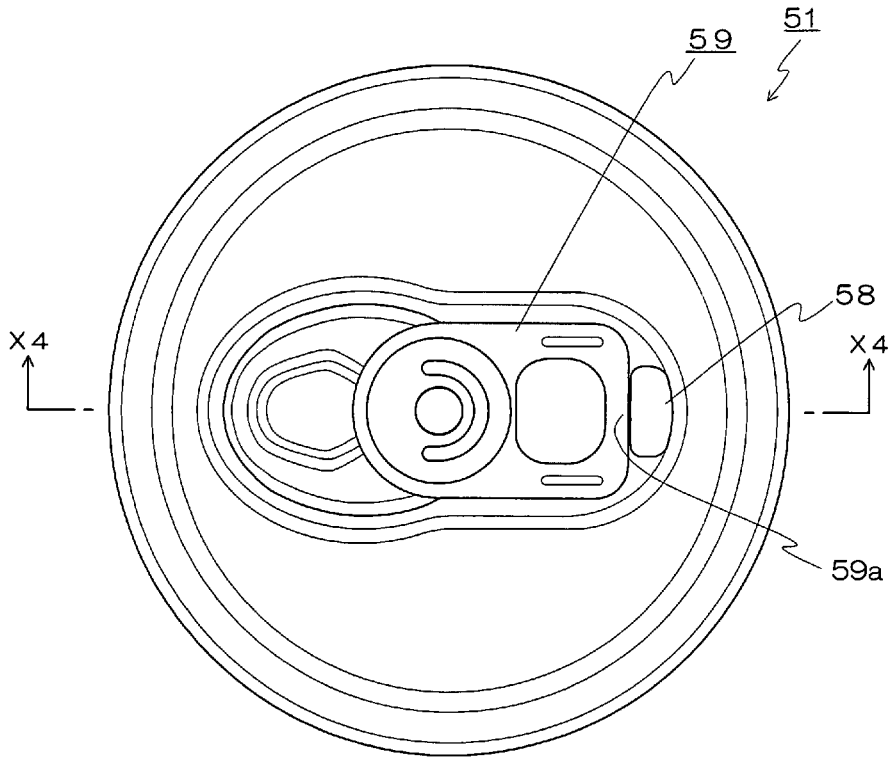
Figure 6:
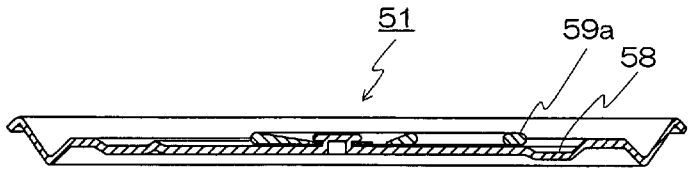

It is to be noted that although in the above first example, the positioning section 30 is formed in place of the guide section 10 employed in the first embodiment, the present invention is not limited to this. Specifically, the positioning section 30 may be additionally provided in combination with the guide section 10 according to the first embodiment. The tab turning can be more effectively prevented by constructing the can lid by using such a combination of the guide section 10 with the positioning section 30. A similar effect can be also obtained by constructing the can lid by using the combination of the stepped plane defining the guide section 40 with the stepped plane defining the positioning section 30*d*, as shown in FIG. 5.

Fourth Embodiment

A fourth embodiment of the present invention is a can container using the can lid 1, 11 or 21 as discussed above. As previously mentioned, the can lid is joined to a cylindrical can body having a bottom to form a can container. To join the can lid to the can body, the can lid is placed in an open end of the can body and a periphery of the can lid is turned back together with an open end portion of the can body.

It is to be noted that although the present invention has been described and illustrated primarily with respect to the can container for beverages, the present invention is not limited to this. Specifically, the present invention may be applied to a can container of a type that can be used for foods and seasonings. Generally, the can container for foods may be structured such that the can lid in its entire area can be separated from the can container. Nevertheless, since the tab can be pulled up to open the can lid in a similar manner to that in the can container for beverages, therefore the similar effect can be obtained by forming the guide section and/or the positioning section in an area adjacent to the center of the pull-up section.

The present invention is applicable to a can container for containing beverages and foods and the like.

The invention claimed is:

1. A can lid comprising: a can lid body having an opening region to be open; and a tab fixed to said can lid body, wherein said tab comprises a pull-up section on which a user's finger is hooked in his/her opening action, a front end abutting the opening region, and a read end opposite the front end and extending in a direction distal from the opening region, the rear end comprising the pull-up section; and said can lid body comprises a finger inserting recess, the entire finger inserting recess positioned behind the pull-up section, and a guide section formed in the finger inserting recess for guiding said user's finger to a center of said pull-up section, wherein said guide section comprises a guide plane having a width gradually narrowing toward said center of said pull-up section, and two surfaces in a plane that is stepped relative to the guide plane, the two surfaces extending such that a distance between said two surfaces is graudually narrowing toward said center of said pull-up section, the distance between the two surfaces corresponding to the width of the guide plane.

2. A can lid according to claim 1, wherein said guide plane is sloped and defining a triangular shape with an apex located proximal to said center of said pull-up section and a guide wall connecting to each oblique line of said guide plane.

3. A can lid comprising a can lid body having an opening region to be open upon being opened and a tab fixed to said can lid body, wherein said tab comprises: a pull-up section on which a user's finger is hooked in his/her opening action, a front end abutting the opening region, and a rear end opposite the front end and extending in a direction distal from the opening region, the rear end comprising the pull-up section; and said can lid body comprises a finger inserting recess, the entire finger inserting recess positioned behind the pull-up section, and a positioning section formed in the finger inserting recess for positioning said user's finger to a center of said pull-up section, the can lid body further comprises a guide section formed in the finger inserting recess for guiding said user's finger to a center of said pull-up section, wherein said guide section comprise: a guide plane having a width gradually narrowing toward said center of said pull-up section; and two surfaces in a plane that is stepped relative to the guide plane, the two surfaces extending such that a distance between said two surfaces is graudually narrowing toward said center of said pull-up section, the distance between the two surfaces corresponding to the width of the guide plane.

4. A can lid according to claim 3, wherein said positioning section is a recessed portion formed in an area adjacent to said center of said pull-up section.

5. A can lid according to claim 3, wherein said guide plane is sloped and defining a triangular shape having an apex located proximal to said center of said pull-up section and a guide wall connecting to each oblique line of said guide plane.

6. A can lid according to claim 1, wherein said pull-up section is formed into a linear shape.

7. A can container comprising a can lid according to claim 1.

* * * * *